US009605915B2

(12) United States Patent
Crock et al.

(10) Patent No.: US 9,605,915 B2
(45) Date of Patent: Mar. 28, 2017

(54) SEMI-AUTOMATED HEAT EXCHANGER TUBE CLEANING ASSEMBLY AND METHOD

(75) Inventors: Terry Lee Crock, Massillon, OH (US); Frank Joseph Moll, Canton, OH (US); James Buchanan, Liburn, GA (US)

(73) Assignee: HYDROCHEM LLC, Atlanta, GA (US)

( * ) Notice: Subject to any disclaimer, the term of this patent is extended or adjusted under 35 U.S.C. 154(b) by 591 days.

(21) Appl. No.: 13/236,077

(22) Filed: Sep. 19, 2011

(65) Prior Publication Data

US 2012/0067370 A1 Mar. 22, 2012

Related U.S. Application Data

(60) Provisional application No. 61/383,965, filed on Sep. 17, 2010.

(51) Int. Cl.

| | |
|---|---|
| ***B08B 9/043*** | (2006.01) |
| ***F28G 1/16*** | (2006.01) |
| ***F28G 3/16*** | (2006.01) |
| ***F28G 9/00*** | (2006.01) |
| ***F28G 15/02*** | (2006.01) |
| ***F28G 15/04*** | (2006.01) |

(52) U.S. Cl.

CPC ..... *F28G 15/02* (2013.01); *B08B 9/043* (2013.01); *F28G 1/16* (2013.01); *F28G 1/163* (2013.01); *F28G 1/166* (2013.01); *F28G 3/16* (2013.01); *F28G 3/163* (2013.01); *F28G 3/166* (2013.01); *F28G 9/00* (2013.01); *F28G 9/005* (2013.01); *F28G 15/04* (2013.01)

(58) Field of Classification Search

CPC . F28G 1/16; F28G 1/163; F28G 1/166; F28G 3/16; F28G 3/163; F28G 3/166; F28G 9/00; F28G 9/005; F28G 15/02

USPC ..... 134/166 C, 166 R, 167 C, 167 R

See application file for complete search history.

(56) References Cited

U.S. PATENT DOCUMENTS

| | | | | |
|---|---|---|---|---|
| 5,442,951 | A | 8/1995 | Gollner et al. | |
| 6,681,839 | B1 * | 1/2004 | Balzer | 165/11.2 |
| 2004/0035445 | A1 * | 2/2004 | Saxon et al. | 134/8 |
| 2009/0145467 | A1 * | 6/2009 | Kahrig | 134/168 C |

FOREIGN PATENT DOCUMENTS

| | | |
|---|---|---|
| EP | 0050362 A2 | 4/1982 |
| FR | 2802450 A1 | 6/2001 |

OTHER PUBLICATIONS

Patent Cooperation Treaty; PCT international Search Report, issued in Connection with PCT/US2011/052162; Aug. 6, 2012; 5 pages; Europe.

Patent Cooperation Treaty; PCT Written Opinion of the International Searching Authority; issued in Connection with PCT/US2911/052162; Aug. 6, 2012;9 pages; Europe.

* cited by examiner

*Primary Examiner* — Jason Ko
*Assistant Examiner* — Levon J Shahinian
(74) *Attorney, Agent, or Firm* — Greenberg Traurig LLP

(57) ABSTRACT

A heat exchanger tube cleaning assembly and method is provided. The assembly can allow for semi-automated tube cleaning of a heat exchanger or other piping or equipment used in an industrial facility such as, for example, a petrochemical plant or oil refinery.

19 Claims, 15 Drawing Sheets

SEMI-AUTOMATED HEAT EXCHANGER TUBE CLEANING ASSEMBLY AND METHOD

RELATED APPLICATIONS

This application claims the benefit, and priority benefit, of U.S. Provisional Patent Application Ser. No. 61/383,965, filed Sep. 17, 2010, titled "Semi-Automated Heat Exchanger Tube Cleaning Assembly and Method," the disclosure of which is incorporated herein in its entirety.

BACKGROUND

1. Field of Invention

This invention relates generally to the cleaning of heat exchangers, and more particularly, to an assembly and method for semi-automated tube cleaning for a heat exchanger or other piping or equipment used in an industrial facility such as, for example, a petrochemical plant or oil refinery.

2. Description of the Related Art

Heat exchangers are commonly used in industrial facilities. Over time, these heat exchangers tend to develop residue on the surfaces of the tubes, tube sheets, tube support plates and other internal structural parts. Over time, this residue can have an adverse affect on the operational performance of the exchangers. The same problem can arise for all piping and tubing found in industrial facilities.

A common cleaning method for this equipment involves the controlled application of a high pressure water and/or chemical stream to the affected areas of the equipment. One or more cleaning lances can be utilized to supply the high pressure water and/or chemical stream.

An operator may stand in clear view of, and near the line-of-fire of, the high pressure stream to direct the stream to the affected areas of the exchanger and control the direction and volume of stream flow. This type of work is extremely labor intensive and potentially hazardous. A person in close proximity to the cleaning environment can be exposed to high pressure water, hazardous cleaning chemicals or other potentially toxic, poisonous or volatile materials.

SUMMARY

Various illustrative embodiments of a heat exchanger tube cleaning assembly and method are provided herein. In an illustrative embodiment, an assembly for cleaning one or more tubes on a tube sheet of a heat exchanger is provided. A first trolley and a second trolley can each be disposed on a track. The first trolley and second trolley can be capable of independent movement along the track. A cleaning device can be disposed on either the first trolley or the second trolley. The cleaning device can be being alignable with a selected tube on the heat exchanger tube sheet to be cleaned. A distancer can be disposed between the first trolley and the second trolley. The distancer can be capable of moving either trolley along the track to adjust the distance therebetween. In certain embodiments, the distancer can be a pneumatic cylinder with a movable piston disposed therewithin. The cleaning device can be a cleaning lance. A spacing rod can be disposed between the first trolley and the second trolley to define the maximum extent to which the distancer may adjust the distance between the two trolleys along the track. An adjustment knob can be disposed on the spacing rod between the first trolley and the second trolley to adjust the maximum extent to which the distancer may adjust the distance between the two trolleys along the track. A first brake can be disposed on the first trolley that is engagable with the track. A second brake can be disposed on the second trolley that is engagable with the track. The track can be disposed on a frame that is mountable on the tube sheet. A mechanical stop can be disposed on the first trolley that is capable of halting movement of the second trolley along the track and towards the first trolley. Alternatively, a mechanical stop can be disposed on the second trolley that is capable of halting movement of the first trolley along the track and towards the second trolley.

In another illustrative assembly, an assembly for cleaning a plurality of tubes on a tube sheet of a heat exchanger is provided. The assembly can include a first track and a second track. A first trolley and a second trolley can each be disposed on the first track. The first trolley and the second trolley can each be capable of moving between adjacent tubes on a row on the x-axis of the tube sheet. A positioning device can be disposed on the second track. The positioning device can be capable of moving between adjacent rows of tubes on the y-axis of the tube sheet. A cleaning device can be disposed on the positioning device. Alternatively, the cleaning device can be disposed on either of the first trolley or the second trolley. The cleaning device can be alignable with the tube to be cleaned on the tube sheet. The first trolley and the second trolley can each be capable of independent movement on the track.

In another illustrative embodiment, an assembly for analyzing one or more tubes on a tube sheet of a heat exchanger is provided. The assembly can include an analyzing device disposed on either the first trolley or the second trolley. The analyzing device can be aligned with a selected tube on the heat exchanger tube sheet to be analyzed. The analyzing device can be used to perform tasks other than cleaning with respect to the exchanger, for example, tube inspection to determine wall thickness, scale buildup or other measurable features.

In another illustrative embodiment, a method of cleaning a first tube and a second tube on a tube sheet of a heat exchanger is disclosed. A track can be provided. A first trolley and a second trolley can be positioned on the track with a distancer disposed therebetween for moving the first trolley and the second trolley between an open respective orientation and a closed respective orientation. A cleaning device can be disposed on either the first trolley or the second trolley. The first trolley and the second trolley can be positioned on the track adjacent the tube sheet so that the cleaning device is aligned with the first tube and the first trolley and a second trolley are in the closed respective orientation. The first tube can be cleaned with the cleaning device. The first trolley can be moved so that the first trolley and the second trolley are in the open respective orientation. The second trolley can be moved so that the first trolley and the second trolley are in the closed respective orientation and the cleaning device is aligned with the second tube. The second tube can then be cleaned with the cleaning device.

In another illustrative embodiment, a method of cleaning a first tube and a second tube on a tube sheet of a heat exchanger is disclosed. A track can be provided. A first trolley and a second trolley can be positioned on the track with a distancer disposed therebetween for moving the first trolley and the second trolley between an open respective orientation and a closed respective orientation. A cleaning device can be disposed on either the first trolley or the second trolley. The first trolley and the second trolley can be positioned on the track adjacent the tube sheet so that the cleaning device is aligned with the first tube and the first trolley and a second trolley are in the open respective orientation. The first tube can be cleaned with the cleaning device. The first trolley can be moved so that the first trolley and the second trolley are in the closed respective orientation. The second trolley can be moved so that the first trolley and the second trolley are in the open respective orientation and the cleaning device is aligned with the second tube. The second tube can then be cleaned with the cleaning device.

In another illustrative embodiment, a method of cleaning a first tube and a second tube on the tube sheet of a heat exchanger is disclosed. A track can be provided. A first trolley and a second trolley can be disposed on the track. A first braking device can be disposed on the first trolley and a second braking device can be disposed on the second trolley. A cleaning device can be disposed on either the first trolley or the second trolley. The first trolley and the second trolley can be positioned on the track adjacent the tube sheet so that the cleaning device is aligned with the first tube and the first braking device and the second braking device are engaged. The first tube can then be cleaned with the cleaning device. The first braking device on the first trolley can be disengaged, and the first trolley can be moved along the track until it is adjacent the second tube. The first braking device can be engaged on the first trolley, and the second braking device can be disengaged on the second trolley. The second trolley can be moved along the track until it is adjacent the second tube. The second braking device can be engaged on the second trolley. The cleaning device can be aligned with the second tube, and the second tube can then be cleaned with the cleaning device.

While certain preferred illustrative embodiments will be described herein, it will be understood that this description is not intended to limit the subject matter to those embodiments. On the contrary, it is intended to cover all alternatives, modifications, and equivalents, as may be included within the spirit and scope of the invention as defined by the appended claims.

DETAILED DESCRIPTION

Referring now to FIGS. 1-15, illustrative embodiments of a heat exchanger tube cleaning assembly and method are provided. Assembly 10 can allow for semi-automated tube cleaning of a heat exchanger 12 or other piping or equipment used in an industrial facility such as, for example, a petrochemical plant or oil refinery.

Figure 1:
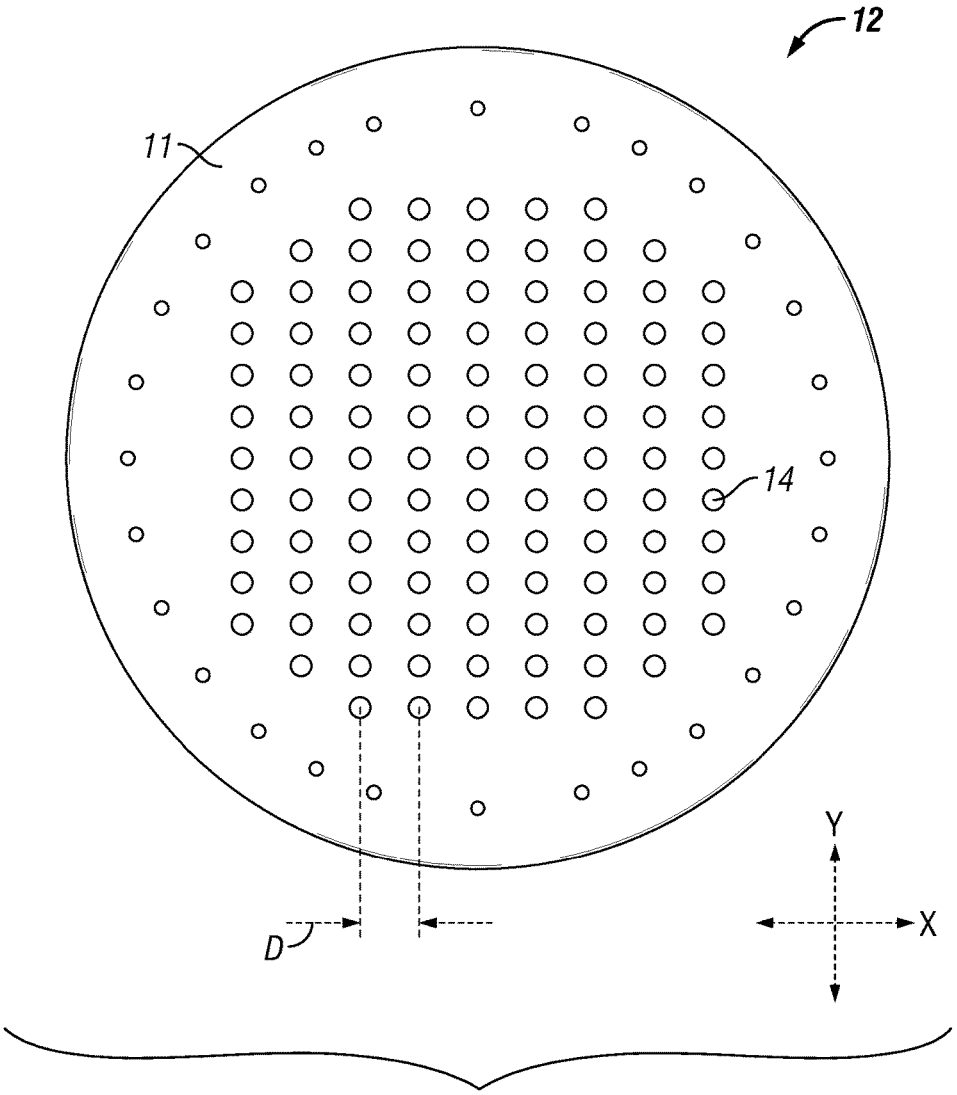
FIG. 1 is a front view of a heat exchanger tube sheet.

FIG. 1 shows an illustrative embodiment of a heat exchanger 12 which can be cleaned using assembly 10. A plurality of tubes 14 having flow passageways are exposed on a tube sheet 11 of exchanger 12. Residue can accumulate in or near, among other areas, the flow passageways of tubes 14. Tube sheet 11 is shown having a plurality of tubes 14 aligned in tube rows, whereby tubes 14 are generally oriented in a square pitch. The horizontal distance between the center points of each tube 14 in a particular tube row is indicated by the distance D. Tube sheet 11 and exchanger 12 can be disposed in a variety of possible positions, including horizontal or vertical orientations.

Figure 2:
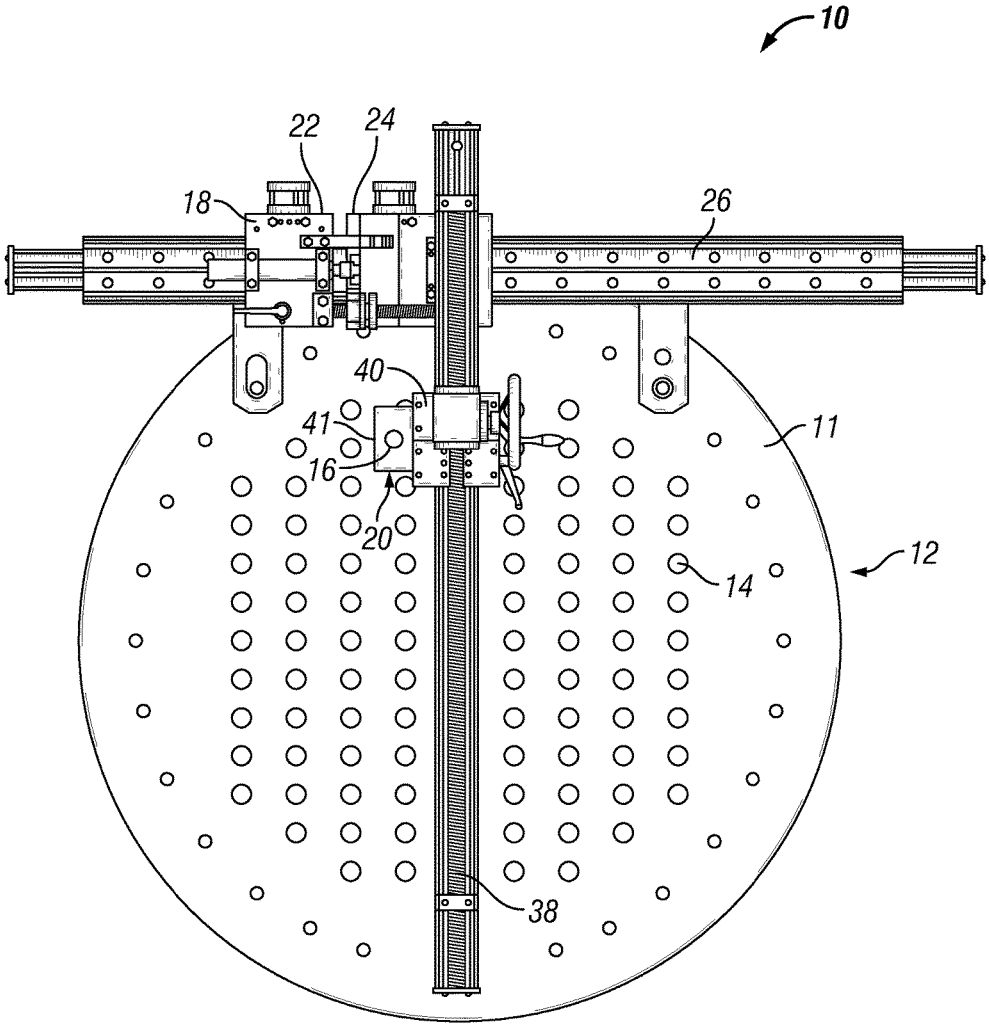
FIG. 2 is a front view of a heat exchanger tube cleaning assembly disposed on a heat exchanger tube sheet in an illustrative embodiment.

FIG. 2 shows an illustrative embodiment of assembly 10. Assembly 10 can be disposed on, or positioned adjacent to, exchanger 12 to be cleaned. Assembly 10 can facilitate the delivery of one or more streams of cleaning materials such as high-pressure water and/or chemicals to the inside of tubes 14 of exchanger 12. The pressurized cleaning stream can remove residue buildup from the inside of these tubes 14 as well as other affected areas. In other illustrative embodiment, assembly 10 can be used to perform tasks other than cleaning with respect to exchanger 12, for example, inspection of tubes 14 to determine wall thickness, scale buildup or other measurable features.

In an illustrative embodiment, a handheld controller 13 (not shown) can be used to control the various directional movements and functionality of components of assembly 10, for example, lance 16 (FIG. 3) for cleaning tubes 14 of exchanger 12. For example, controller 13 can control the various movements of assembly 10 along the x axis and y axis (determined with respect to tube sheet 11) and the distance that lance 16 extends outward, or retracts inward, with respect to tube 14. If desired, controller 13 can also control other features not relating to directional movement such as, for example, the rate at which water or other cleaning fluid is sprayed from lance 16, or non-cleaning related tasks to the extent work other than cleaning is performed.

Controller 13 can comprise, for example, one or more recognized user input devices such as a touch screen, a joystick controller, pushbutton, a mouse or a trackball, which would all be in accordance with the present illustrative embodiments. Further, different devices can control different functions. For example, a joystick can control movement of the lances 16, while a push button can control directional movement of assembly 10. In an illustrative embodiment, controller 13 is remotely located from assembly 10. For example, controller 13 can communicate with assembly 10 via hardwiring, such as an umbilical cable, or can communicate with assembly 10 via a wireless communications network, which can take the form of radio signals, Internet or other similar communication forms. Controller 13 can allow for precision control by an operator of certain components of assembly 10 at a location that is remote, that is, physically distant, from the location of exchanger 12.

Figure 3:
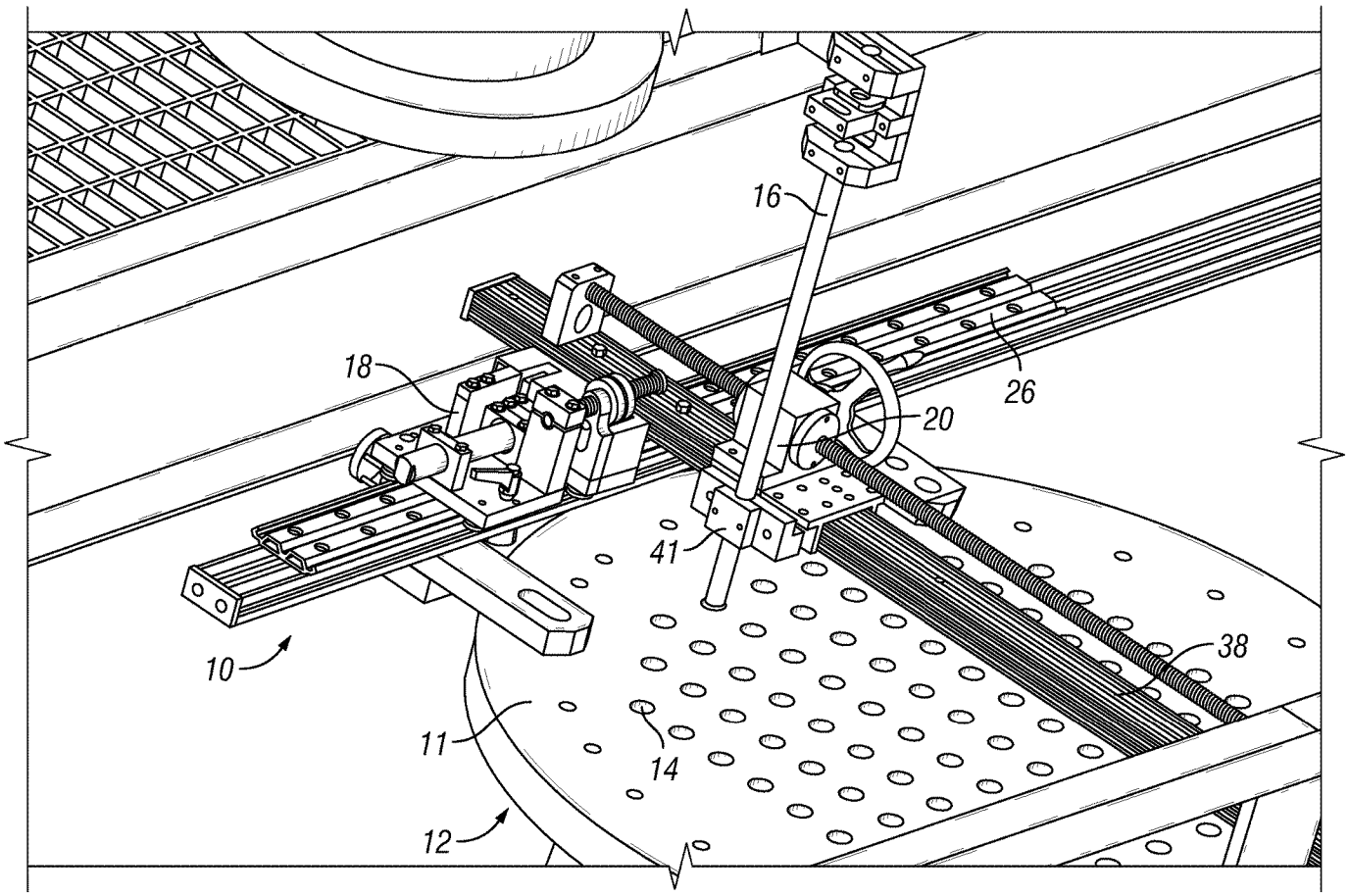
FIG. 3 is a perspective view of a heat exchanger tube cleaning assembly disposed on a heat exchanger tube sheet in an illustrative embodiment.

FIG. 3 shows an illustrative embodiment of cleaning lance 16 disposed on assembly 10 for cleaning tubes 14. In various illustrative embodiments, cleaning lance 16 can be disposed on any location on assembly 10 that will provide effective and efficient cleaning. It is also recognized that various styles of lance 16, or other cleaning instruments, can also be utilized and would be in accordance with the present illustrative embodiments. Lance 16 can emit high pressure cleaning materials and can be rigid, semi-rigid or flexible as desired. A pumping station may supply cleaning materials (including, but not limited to, high-pressure water to approximately 50,000 PSI) to cleaning lance 16.

Lance 16 can include a single nozzle, or can include a plurality of nozzles on its outer surface through which cleaning materials are emitted. Lance 16 can be disposed outside of, or within, tube 14 during cleaning. Further, lance 16 can rotate, in certain illustrative embodiments, to allow for better distribution of cleaning materials. In certain illustrative embodiments, multiple adjacent lances 16 can be utilized, or lances 16 may be staggered such that they form, for example, a triangular, rectangular or any other shaped pattern to correspond to the arrangement of multiple rows of tubes 14 on tube sheet 11.

Figure 4:
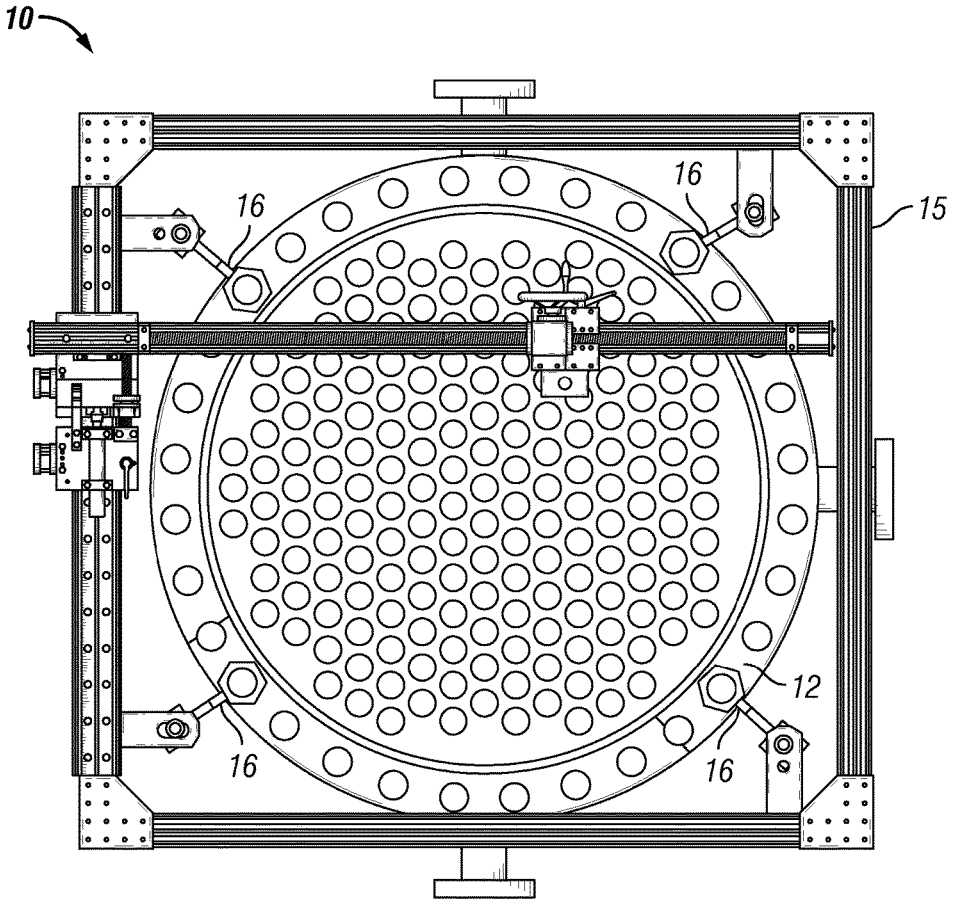
FIG. 4 is a perspective view of a heat exchanger tube cleaning assembly with a mounting frame disposed on a heat exchanger tube sheet in an illustrative embodiment.
Figure 5:
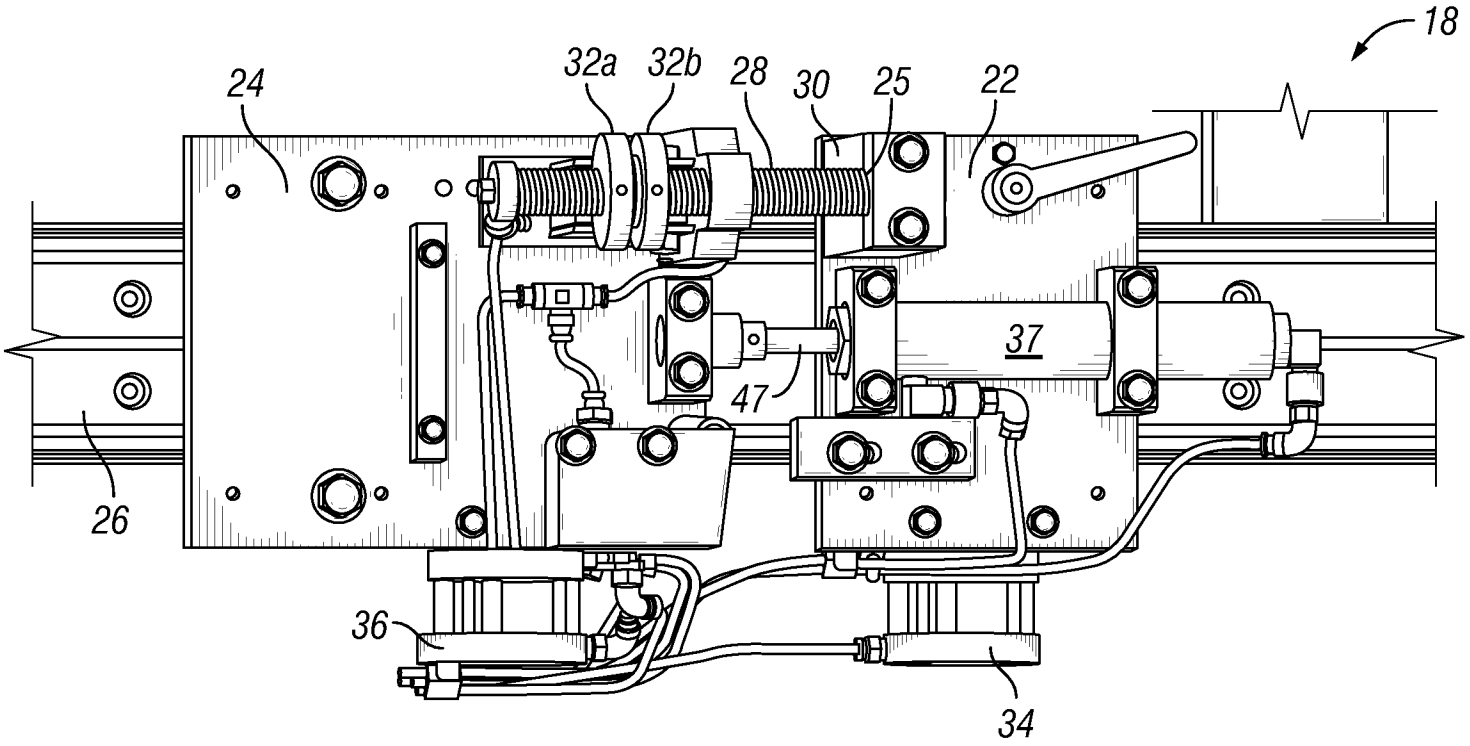
FIG. 5 is a perspective view of a heat exchanger tube cleaning assembly in an illustrative embodiment.
Figure 6:
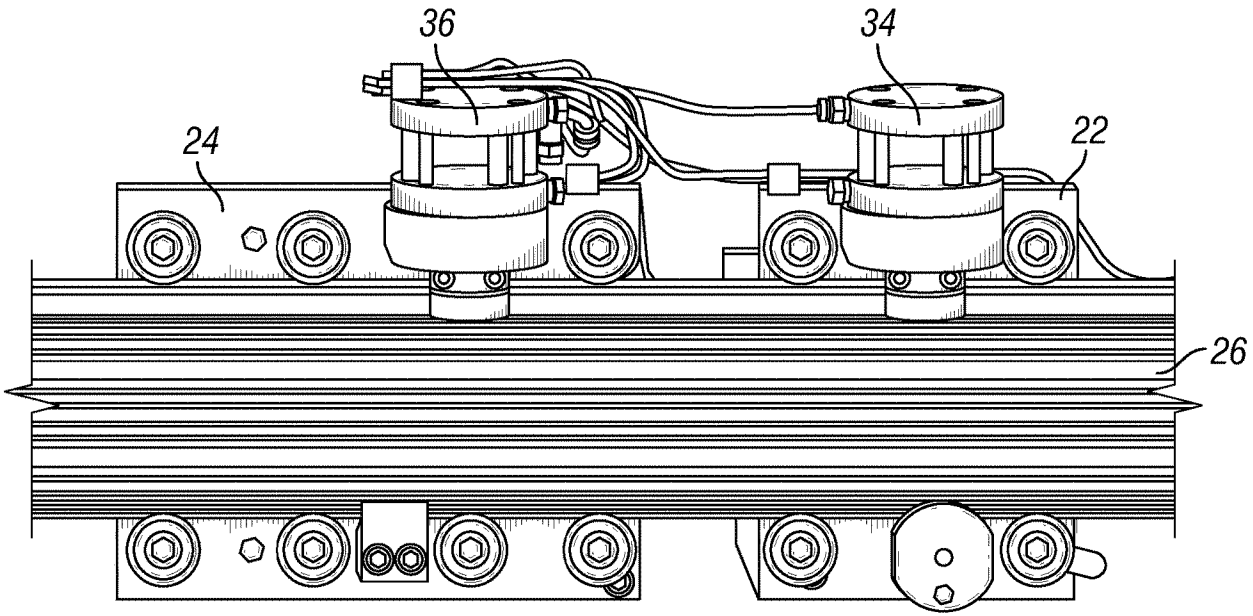
FIG. 6 is a front view of a heat exchanger tube cleaning assembly in an illustrative embodiment.
Figure 7:
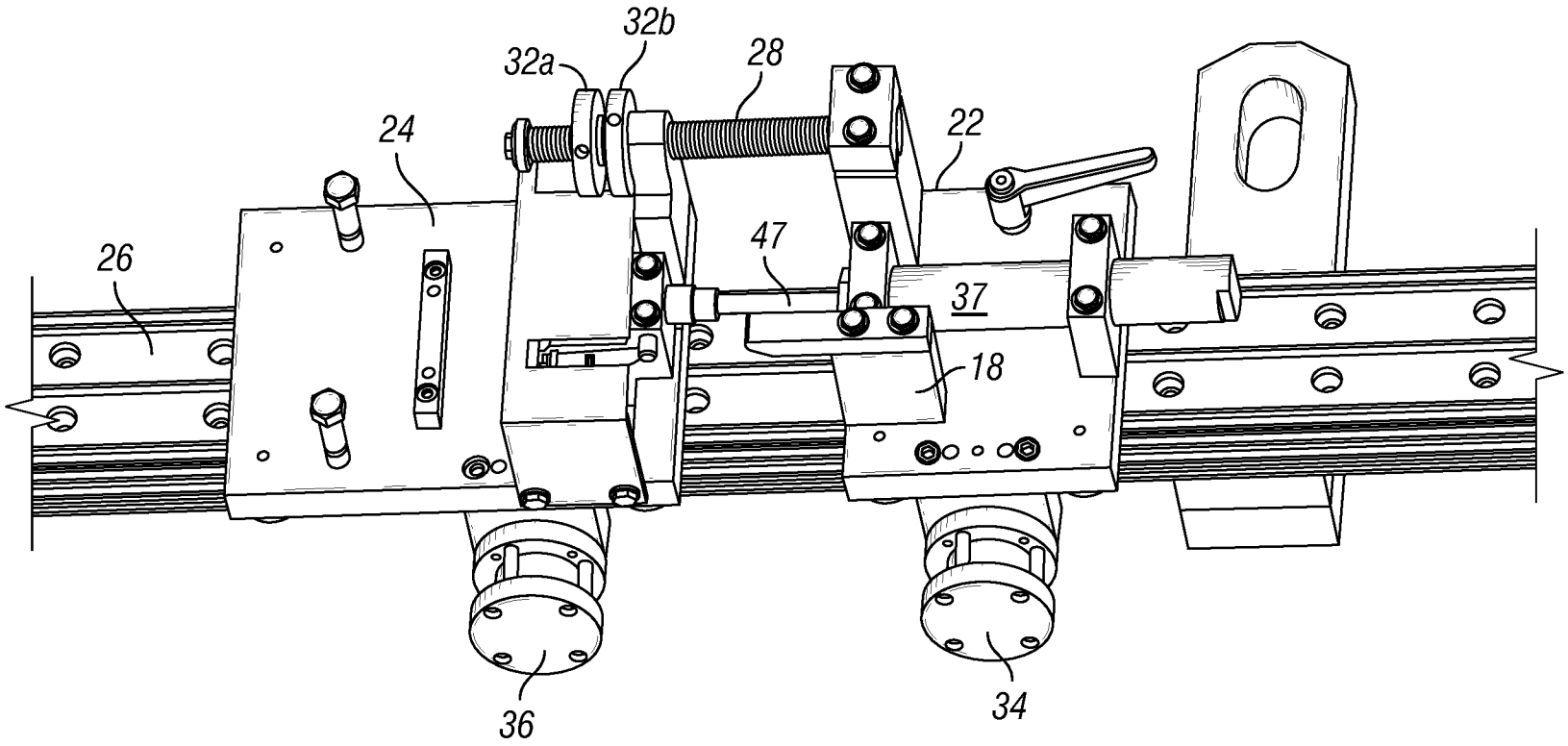
FIG. 7 is a perspective view of a heat exchanger tube cleaning assembly in an illustrative embodiment.

As illustrated in FIG. 4, assembly 10 can be mounted to exchanger 12 via a frame 15 or other mounting means to restrict movement of assembly 10. Frame 15 can contact exchanger 12 at one or more mounting points 16. Frame 15 is preferably utilized to connect assembly 10 to exchanger 12, such that assembly 10 will have little or no movement relative to exchanger 12. Alternatively, assembly 10 can be positioned adjacent to exchanger 12 without being mounted thereon, such that cleaning lance 16 and tubes 14 of exchanger 12 are generally on the same plane and lance 16 can travel in and out of the respective tubes 14 with minimal resistance. Assembly 10 can also be positioned on wheels, if desired, so long as the wheels do not substantially affect movement of assembly 10 with respect to exchanger 12 during cleaning.

In various illustrative embodiments (see, e.g., FIG. 2), assembly 10 can include cleaning lance 16 (and its related piping), an x-axis positioning device 18 for maneuvering the position of cleaning lance 16 with respect to one or more rows of tubes 14 along the x-axis of exchanger 12, and a y-axis positioning device 20 for maneuvering the position of cleaning lance 16 with respect to one or more columns of tubes 14 along the y-axis of exchanger 12.

In various illustrative embodiments (see, e.g., FIGS. 5-7), x-axis positioning device 18 can include a first trolley 22 and a second trolley 24, which can be engaged to move in either a leftward or rightward direction along an x-axis oriented track 26. In certain embodiments, first trolley 22 and second trolley 24 are capable of independent movement on the track, meaning that one trolley can move along the track while the other is stationary.

A distancer, such as a pneumatic cylinder 37 with moveable piston 47, can be disposed between first trolley 22 and second trolley 24 to move either trolley 22, 24 along the track and thereby adjust the distance therebetween. For example, pneumatic cylinder 37 can be disposed adjacent to x-axis positioning device 18 and affixed thereto. Pneumatic cylinder 37 can expand or retract moveable piston 47 to move one, or both, of first trolley 22 and second trolley 24 along x-axis oriented track 26. First trolley 22 can have a first trolley brake 34 disposed thereon to grip x-axis oriented track 26 and allow, or prevent, movement of first trolley 22 along track 26. Second trolley 24 can have a second trolley brake 36 disposed thereon to grip x-axis oriented track 26 and allow, or prevent, movement of second trolley 24 along track 26.

First trolley 22 and second trolley 24 can be connected by a spacing rod 28. The end of spacing rod 28 adjacent to first trolley 22 can sit within an orifice 25 in first trolley 22. As first trolley 22 and second trolley 24 move closer together, spacing rod 28 moves further through orifice 25. In certain embodiments, first trolley 22 has a mechanical stop 30 that engages second trolley 24 and prevents further movement of second trolley when spacing rod has passed through orifice 25 a desired distance. As first trolley 22 and second trolley 24 move further apart, spacing rod 28 can move further out of orifice 25, but in a preferred embodiment, does not fully exit orifice 25. In certain illustrative embodiments, the length of spacing rod 28 will define the maximum distance that first trolley 22 and second trolley 24 can be spaced apart by pneumatic cylinder 37 along track 26.

The end of spacing rod 28 adjacent second trolley 24 has an adjusting knob 32 that can be manually adjusted so that the distance between first trolley 22 and second trolley 24 can be increased or reduced. A plurality of adjustment knobs 32*a* and 32*b* can also be utilized. In certain illustrative embodiments, the position of adjustment knobs 32*a* and 32*b* will define the adjusted maximum distance that first trolley 22 and second trolley 24 can be spaced apart by pneumatic cylinder 37 along track 26. Preferably, the distance between first trolley 22 and second trolley 24 is set to generally correspond to the distance D between the respective tubes 14, along the x-axis, on tube sheet 11 of exchanger 12.

Y-axis positioning device 20 (see FIG. 2) can comprise a lance tram 40 and a holding device 41 disposed on a y-axis-oriented track 38. In certain embodiments, cleaning lance 16 can be connected to lance tram 40 via holding device 41. Holding device 41 can also be used to hold other inspecting, analyzing or measurement devices when assembly 10 is not utilized for cleaning purposes. The location of lance tram 40 can be adjusted along the length of y-axis oriented track 38 such that lance 16 is aligned with a desired row of tubes 14 of exchanger 12 for cleaning thereof. Y-axis oriented track 38 can also be connected to first trolley 22 or second trolley 24 of x-axis positioning device 18 such that when x-axis positioning device 18 moves along track 26, y-axis oriented track 38 also moves therewith.

Figure 8:
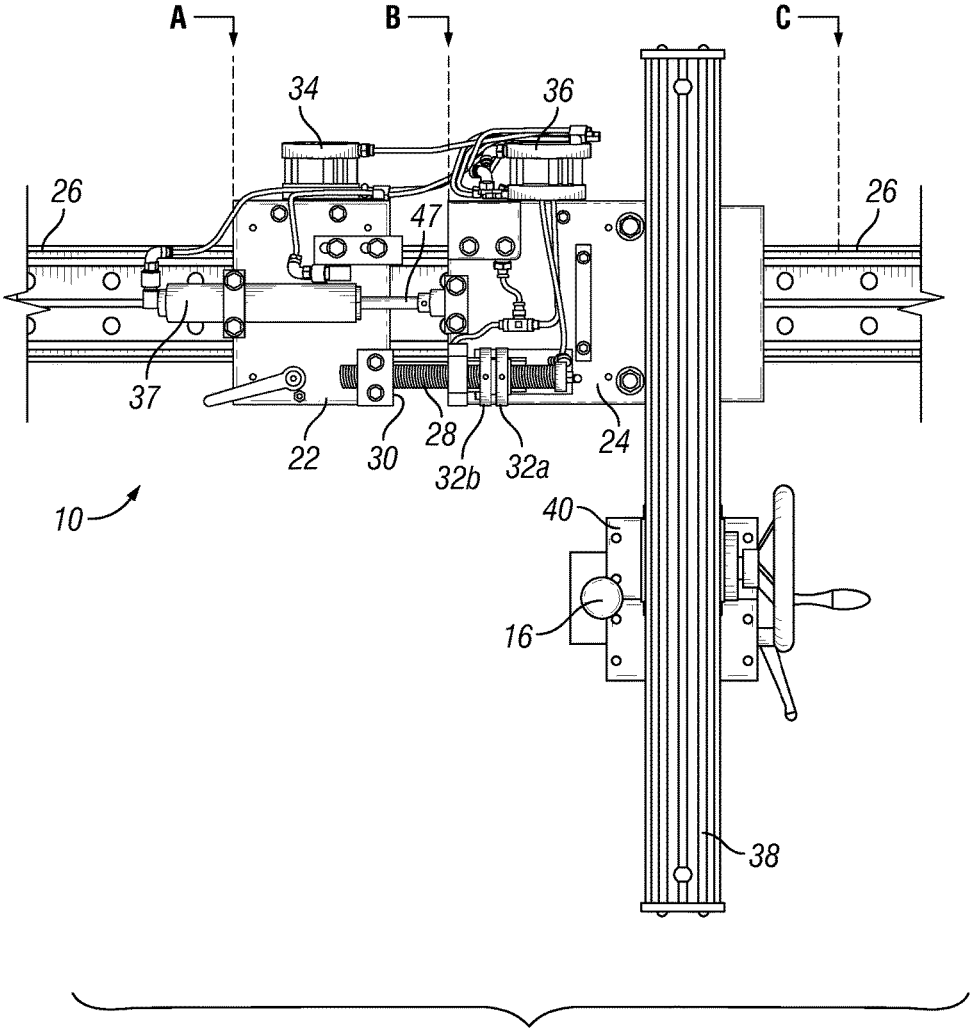
FIG. 8 is a front view of a first step in a method of moving a heat exchanger tube cleaning assembly in an illustrative embodiment.
Figure 9:
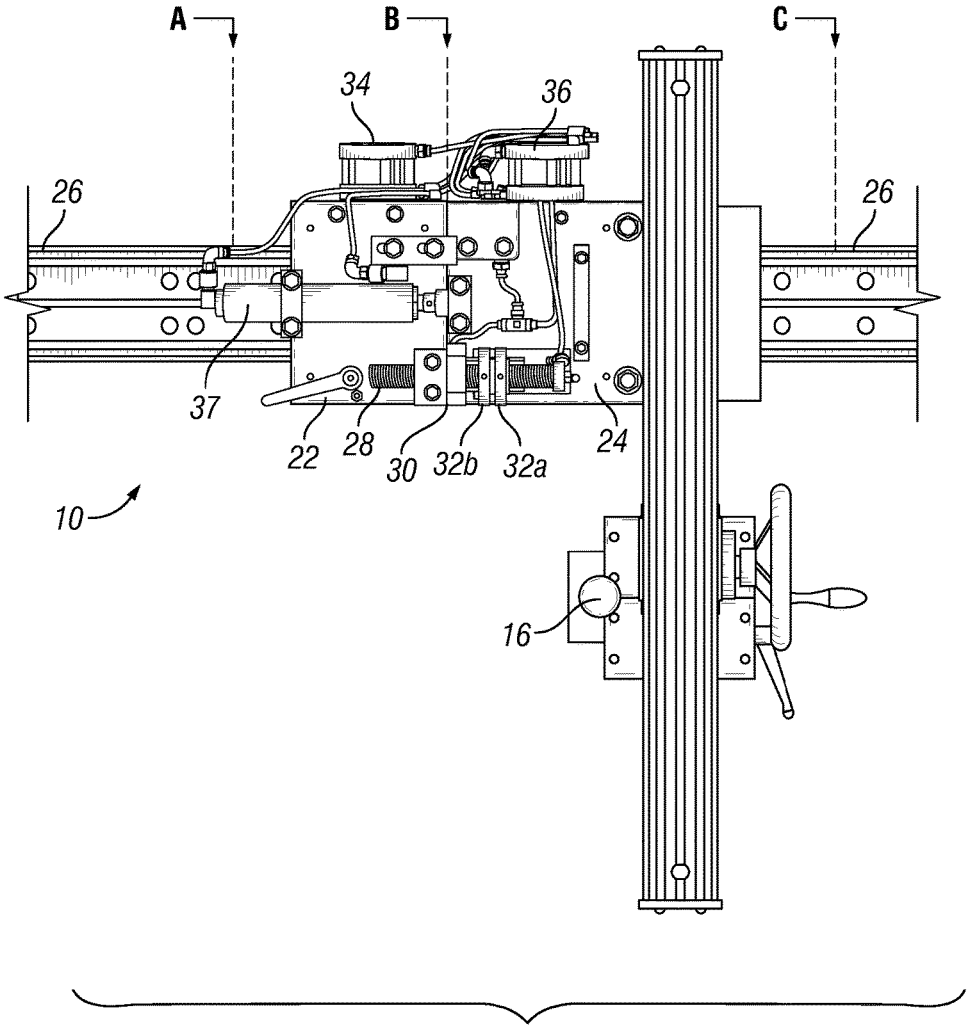
FIG. 9 is a front view of a second step in a method of moving a heat exchanger tube cleaning assembly in an illustrative embodiment.
Figure 10:
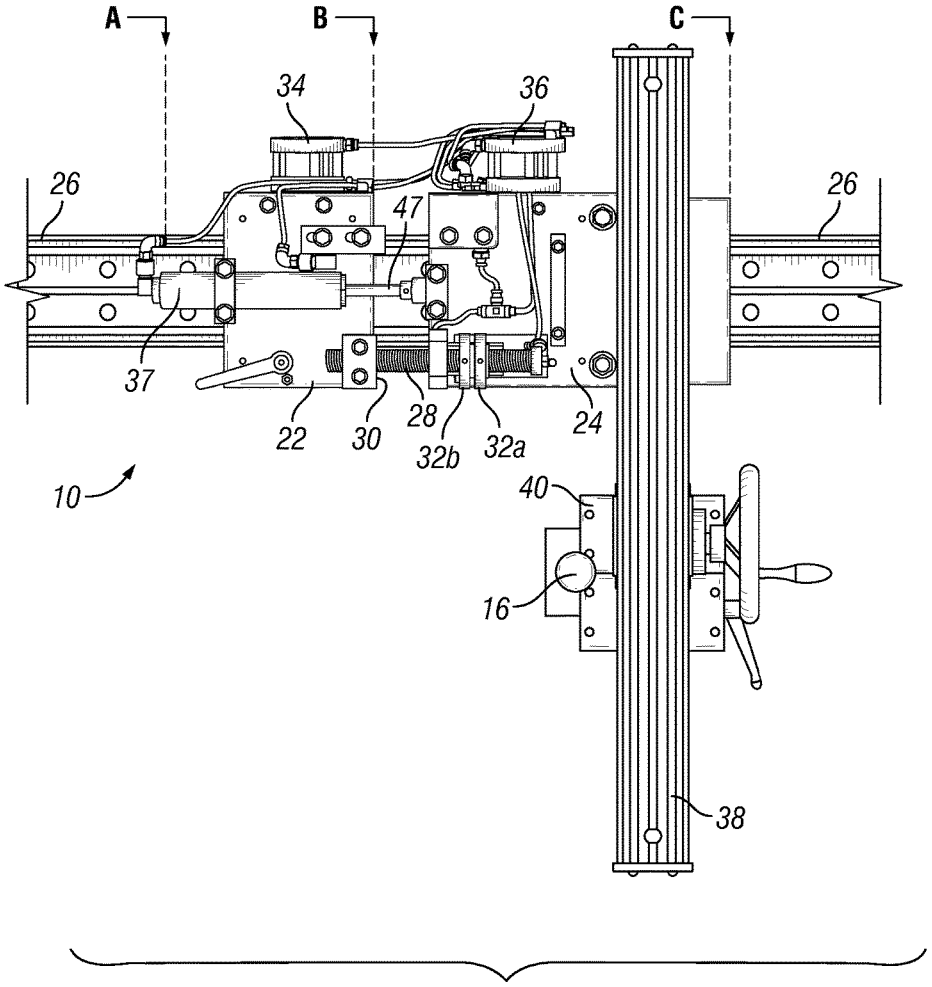
FIG. 10 is a front view of a third step in a method of moving a heat exchanger tube cleaning assembly in an illustrative embodiment.
Figure 11:
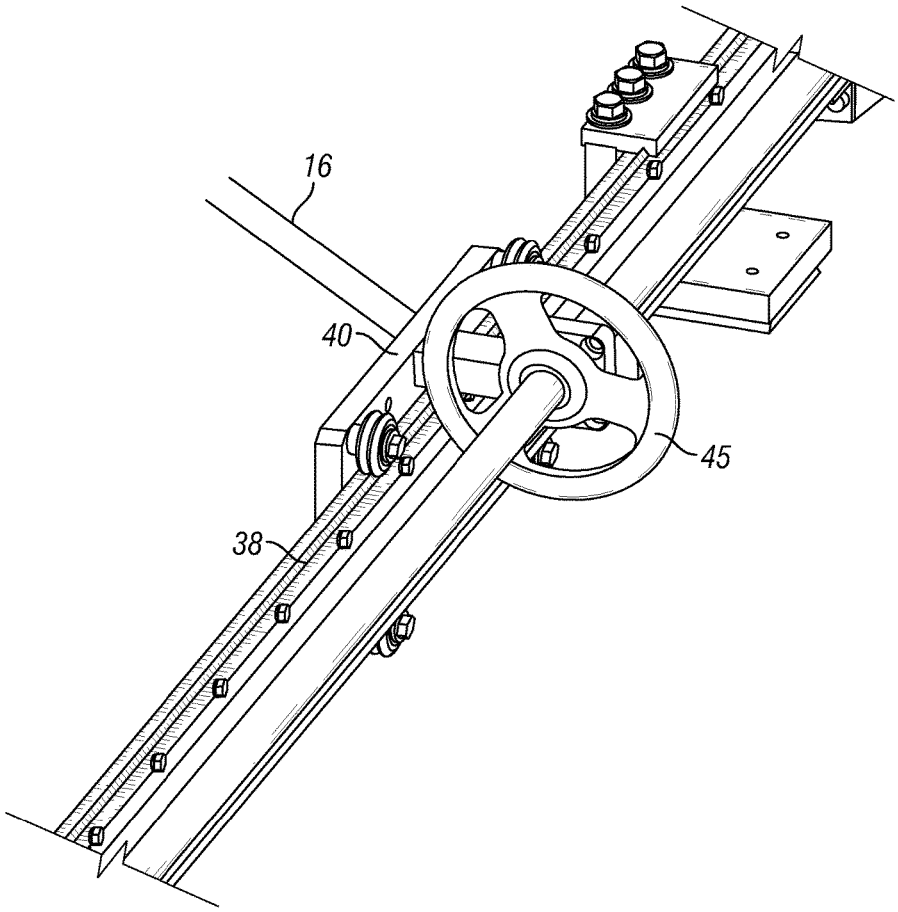
FIG. 11 is a perspective view of an adjustment wheel for a heat exchanger tube cleaning assembly in an illustrative embodiment.
Figure 12:
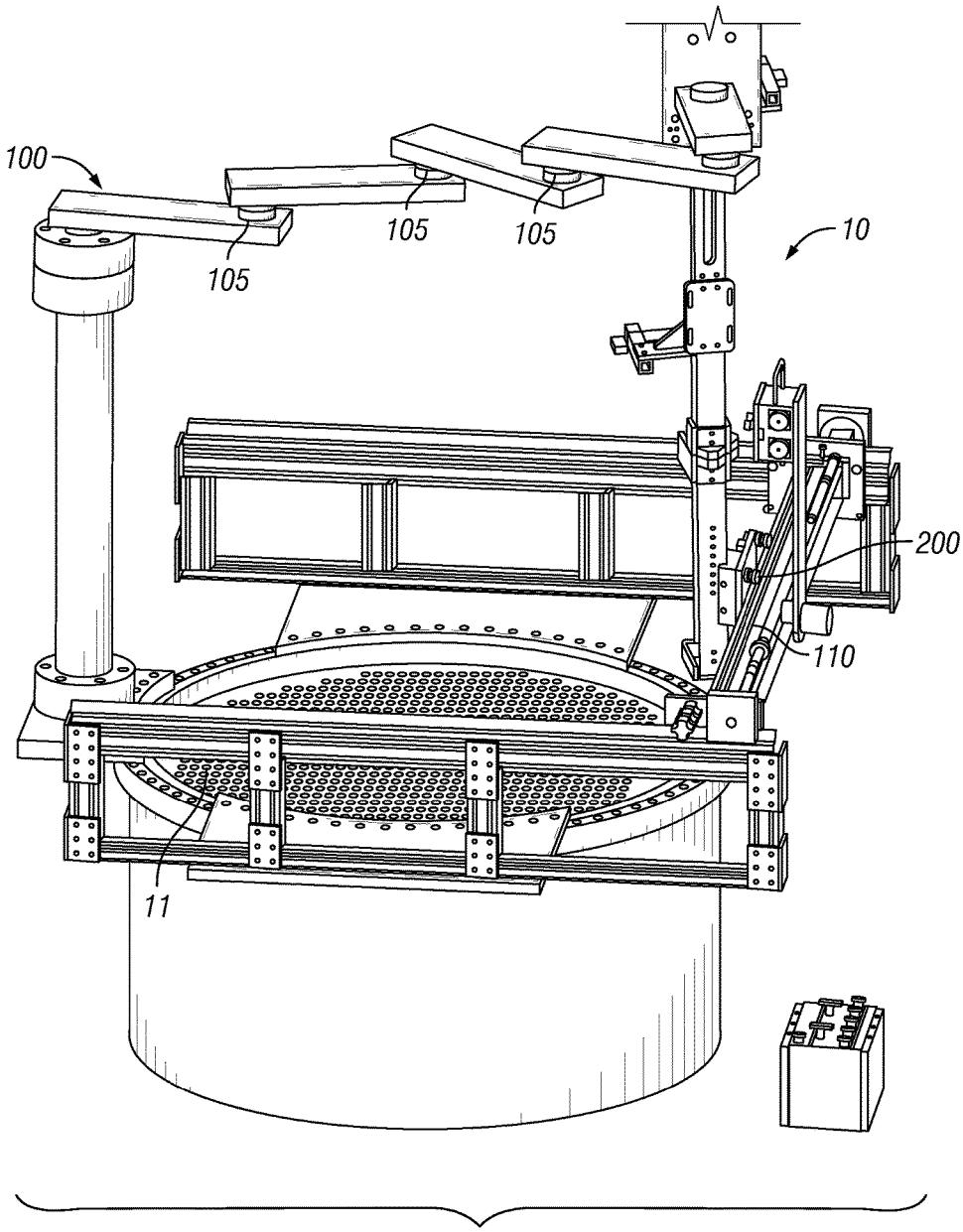
FIG. 12 is a perspective view of a heat exchanger tube cleaning assembly for cleaning along the x-axis and y-axis of a tube sheet in an illustrative embodiment.
Figure 13:
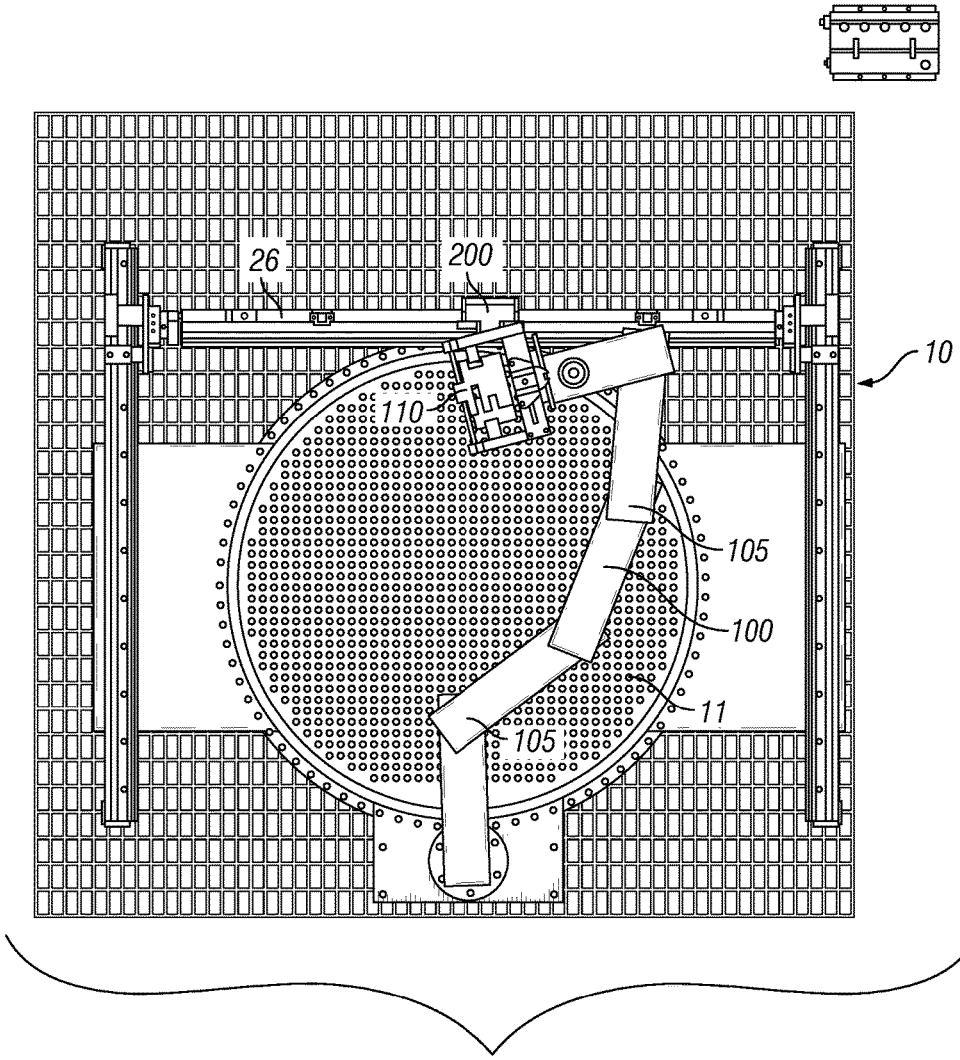
FIG. 13 is a front view of a heat exchanger tube cleaning assembly for cleaning along the x-axis and y-axis of a tube sheet in an illustrative embodiment.
Figure 14:
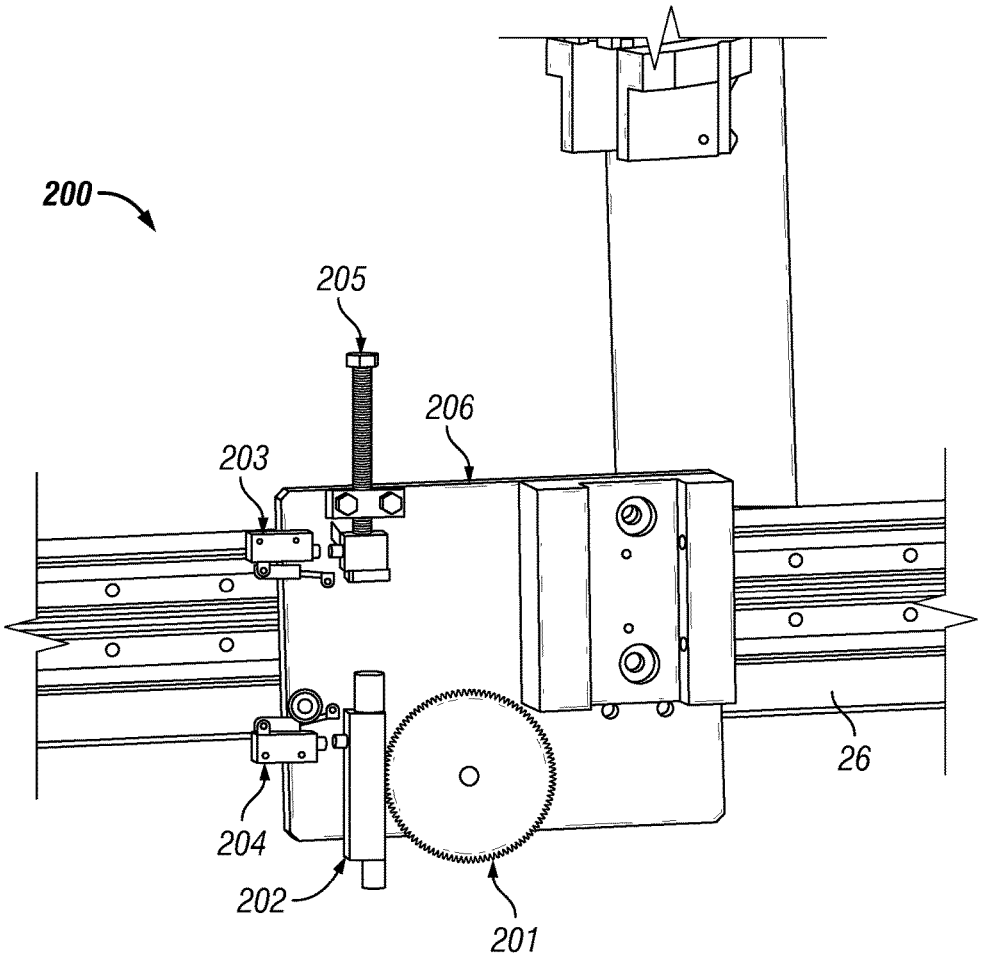
FIG. 14 is a front perspective view of a tube cleaning assembly having a rotary indexer for cleaning along the x-axis and y-axis of a tube sheet in an illustrative embodiment.
Figure 15:
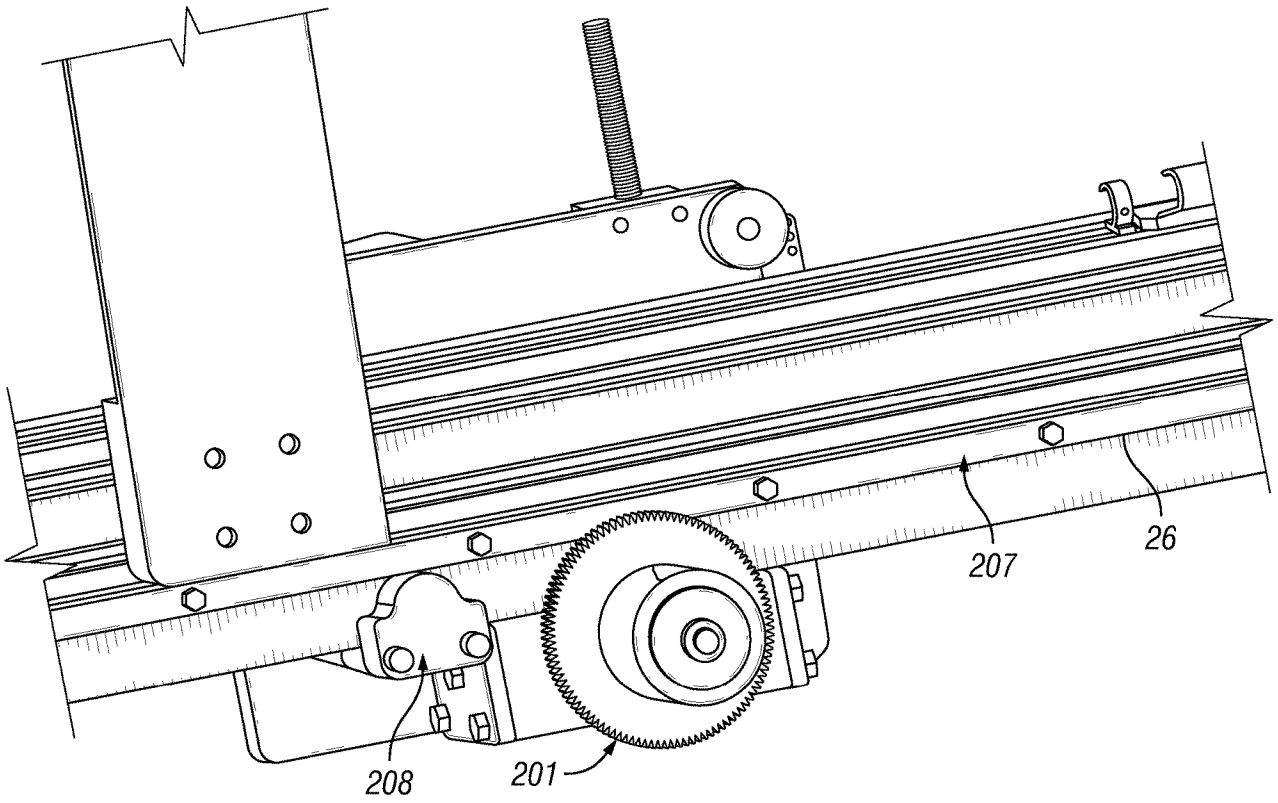
FIG. 15 is a rear perspective view of a tube cleaning assembly having a rotary indexer for cleaning along the x-axis and y-axis of a tube sheet in an illustrative embodiment.

In the illustrative embodiments shown in FIGS. 8-10, assembly 10 can be configured to move along a tube row of tube sheet 11, on the x-axis, in a stepwise, self-automated manner, such that cleaning lance 16 will generally align with each of the tubes 14 in that tube row. Various methods of maneuvering assembly 10 with respect to tube sheet 11 of heat exchanger 12 are also contemplated, whereby assembly 10 can be manipulated to move along the x-axis with respect to tube sheet 11 to clean tubes 14. Although the stepwise movement of assembly 10 can begin at any one of the steps shown in FIGS. 8-10, for illustrative purposes, movement of assembly 10 for cleaning of tubes 14 will be described herein beginning with the position shown in FIG. 8.

In FIG. 8, assembly 10 is disposed on track 26. First trolley 22 is in the A position. Second trolley 24 is in the B position. Neither first trolley 22 nor second trolley 24 is located in the C position. Brake 34 on first trolley 22 is locked. Brake 36 on second trolley 24 is locked. Second trolley 24 does not contact mechanical stop 30, and first trolley 22 and second trolley 24 are in an open respective configuration. Movable piston 47 of pneumatic cylinder 37 is initially in the open position, meaning cylinder 37 is expanded.

In FIG. 9, assembly 10 moves along track 26. Brake 34 on first trolley 22 is unlocked. Brake 36 on second trolley 24 remains locked. Movable piston 47 of pneumatic cylinder 37 moves from the open position to the closed position, meaning that cylinder 37 moves from an expanded position to a retracted position. When cylinder 37 moves to the retracted position, first trolley 22 is pushed away from the A position and closer to, or contacting, second trolley 24 in the B position. First trolley 22 and second trolley 24 are now in an closed respective configuration. Neither first trolley 22 nor second trolley 24 is located in the C position. Second trolley 24 is flush against mechanical stop 30.

In FIG. 10, assembly 10 continues to move along track 26. Brake 34 on first trolley 22 is locked. Brake 36 on second trolley 24 is unlocked. Movable piston 47 of pneumatic cylinder 37 moves from the closed position to the open position, meaning that cylinder 37 moves from a retracted position to an expanded position. When cylinder 37 moves to an expanded position, second trolley 24 is pushed away from the B position and to the C position. Second trolley 24 is no longer flush against mechanical stop 30, and first trolley 22 and second trolley 24 are again in an open respective configuration.

According to the illustrative embodiments shown in FIGS. 8-10, assembly 10 will preferably move along a tube row on the x-axis of tube sheet 11 in a stepwise, semi-automated manner. Adjustment knobs 32*a* and 32*b* on spacing rod 28 will preferably be set such that cleaning lance 16 can align with each of consecutive and/or adjacent tubes 14 in the tube row when assembly 10 moves in the manner illustrated in FIGS. 8-10. For example, if distance D between tubes 14 on tube sheet 11 is three inches, adjustment knobs 32*a* and 32*b* can be set so that cleaning lance 16 is moved in successive three inch intervals along the x-axis. By setting adjustment knobs 32*a* and 32*b* to an appropriate distance, cleaning lance 16 can move along the x-axis in a stepwise, semi-automated manner to clean successive tubes on tube sheet 11. Movement of assembly 10 along the x-axis can occur while lance 16 is cleaning any one particular tube 14, or alternatively, while lance 16 is between any two tubes 14 in various illustrative embodiments.

Once cleaning lance 16 has reached the last tube 14 on a respective row, an operator can reposition lance tram 40 on track 38 using, for example, an adjustment wheel 45 (see, e.g., FIG. 11) so that cleaning lance 16 will be aligned with the first tube 14 on a different row to be cleaned. Repositioning of lance tram 40 can be done manually by the operator, or can be automated in various illustrative embodiments. Further, assembly 10 can be re-oriented on tube sheet 11 such that tube cleaning occurs along the y-axis, with repositioning occurring along the x-axis, in certain illustrative embodiments.

In certain illustrative embodiments, assembly 10 can recalibrate or realign its position along the x-axis with respect to exchanger 12 to adjust for any changes relative to its position at the beginning of the cleaning process. These possible changes can be a result of, for example, shifting of assembly 10 or its components relative to exchanger 12 as assembly 10 travels along the tube row, which would result in cleaning lance 16 not lining up with subsequent tubes 14 in the tube row. In an illustrative embodiment, a user can unlock brake 34 on first trolley 22 and brake 36 on second trolley 24 when the x-axis positioning device 18 is located adjacent to tube 14 that is being cleaned. By unlocking brake 34 and brake 36, x-axis positioning device 18 is provided a small degree of "give" which allows the cleaning lance 16 to readjust itself with respect to the location of tube 14. Readjustment can be caused by, for example, the pressure of the water or other fluid which exits cleaning lance 16. In an illustrative embodiment, the amount of "give" available to cleaning lance 16 can be in the range from +/− six (6) inches along the x-axis in either direction, within which range cleaning lance 16 can realign itself with tube 14.

In certain illustrative embodiments as shown in FIGS. 12-15, assembly 10 can be configured to move along tube sheet 11, on both the x-axis and the y-axis, in a stepwise, self-automated manner, such that assembly 10 can be used to clean tubes 14 which are oriented, for example, in a triangular or other shaped pitch on tube sheet 11 of exchanger 12. A flexible arm 100 with a plurality of movable hinges 105 can be used to position a cleaning device 110 in a variety of precise orientations on tube sheet 11. In certain embodiments, cleaning device 110 can be used for other tasks besides cleaning, such as, for example, tube scanning or analysis. In an illustrative embodiment, a rotary indexer 200 driven by a rotary motor 250 (not shown) can be disposed on cleaning device 110. Rotary indexer 200 can be utilized to move cleaning device 110 along tube sheet 11 of exchanger 12. Rotary indexer 200 can comprise a rotary trolley 206 having a rotary drive gear 201 disposed thereon. Drive gear 201 can contact and move a limit rack 202 in an upward or downward direction with respect to tube sheet 11. Limit rack 202 can contact an upper limit switch 203 and a lower limit switch 204 disposed on rotary indexer 200. A limit switch travel adjustment pin 205 can be adjusted to set the position of upper limit switch 203. Trolley 206 can sit on a drive rack 207 disposed on track 26. Trolley brake 208 can contact drive rack 207. Rotary gear 201 can travel along drive rack 207 for a desired amount of lateral displacement that can be predetermined by setting the limit switch travel adjustment pin 205. In certain illustrative embodiments, indexing can be controlled and repeated by utilizing a handheld controller or other like control device. When brake 208 is released, rotary gear 201 can rotate in a clockwise direction and move rotary gear 201 along drive rack 207 as drive limit rack 202 moves upward until it contacts upper limit switch 203. When upper limit switch 203 is contacted and activated, brake 208 is applied and rotary motor 250 can disengage the drive clutch and reverse rotation of rotary gear 202 to a counterclockwise direction, returning drive limit rack 202 to the home position. Because the drive clutch is disengaged during the counterclockwise rotary motion, trolley 206 does not reverse direction on drive rack 207, in certain illustrative embodiments. This cycle can be repeated multiple times to move trolley 206 in an inchworm-type fashion along drive rack 207.

It is to be understood that the subject matter herein is not limited to the exact details of construction, operation, exact materials, or illustrative embodiments shown and described, as modifications and equivalents will be apparent to one skilled in the art. Accordingly, the subject matter is therefore to be limited only by the scope of the appended claims.

What is claimed is:

1. An assembly for cleaning one or more tubes on a tube sheet of a heat exchanger, the assembly comprising:

a track;

a first trolley and a second trolley each directly disposed on the track and capable of independent movement therealong;

a cleaning device disposed on either the first trolley or the second trolley, the cleaning device being alignable with a selected tube on the heat exchanger tube sheet to be cleaned; and a distancer disposed between the first trolley and the second trolley and capable of moving either trolley along the track to adjust the distance therebetween.

2. The assembly of claim 1, wherein the distancer comprises a pneumatic cylinder having a movable piston disposed therewithin.

3. The assembly of claim 1, wherein the cleaning device comprises a cleaning lance.

4. The assembly of claim 1, further comprising a spacing rod disposed between the first trolley and the second trolley and defining the maximum extent to which the distancer may adjust the distance therebetween along the track.

5. The assembly of claim 4, further comprising an adjustment knob, disposed on the spacing rod between the first trolley and the second trolley, and capable of adjusting the maximum extent to which the distancer may adjust the distance therebetween along the track.

6. The assembly of claim 4, wherein the spacing rod has a first end attached to the first trolley and a second end attached to the second trolley.

7. The assembly of claim 4, wherein the distancer has a first end attached to the first trolley and a second end attached to the second trolley, and the spacing rod has a first end attached to the first trolley and a second end attached to the second trolley.

8. The assembly of claim 1, further comprising a first brake disposed on the first trolley and engagable with the track such that the brake directly contacts the track to prevent movement of the first trolley along the length of the track.

9. The assembly of claim 8, further comprising a second brake disposed on the second trolley and engagable with the track such that the brake directly contacts the track to prevent movement of the first trolley along the length of the track.

10. The assembly of claim 1, further comprising a frame having the track disposed thereon, the frame being mountable on the tube sheet.

11. The assembly of claim 1, further comprising a mechanical stop disposed on the first trolley and capable of halting movement of the second trolley along the track and towards the first trolley.

12. The assembly of claim 1, further comprising a mechanical stop disposed on the second trolley and capable of halting movement of the first trolley along the track and towards the second trolley.

13. The assembly of claim 1, wherein the distancer has a first end attached to the first trolley and a second end attached to the second trolley.

14. The assembly of claim 1, wherein the first trolley and the second trolley are directly mounted on the track and maintain direct contact with the track while the first trolley and the second trolley move along the track.

15. An assembly for cleaning one or more tubes on a tube sheet of a heat exchanger, the assembly comprising:

a first track;

a first trolley and a second trolley each disposed on the first track and capable of independent movement therealong;

a second track disposed on either the first trolley or the second trolley;

a cleaning device disposed on the second track and capable of movement therealong, the cleaning device being alignable with a selected tube on the heat exchanger tube sheet to be cleaned; and a distancer disposed between the first trolley and the second trolley and capable of moving either trolley along the first track to adjust the distance therebetween.

16. The assembly of claim 15, wherein the cleaning device comprises a lance tram mounted on the second track with a cleaning lance disposed thereon.

17. The assembly of claim 15, wherein the first track is alignable along a horizontal axis with respect to the tube face and the second track is alignable with a vertical axis with resect to the tube face.

18. The assembly of claim 15, wherein the first track is alignable along a vertical axis with respect to the tube face and the second track is alignable with a horizontal axis with resect to the tube face.

19. The assembly of claim 15, wherein the second track is disposed on either the first trolley or the second trolley in a substantially perpendicular orientation to the first track.

* * * * *